US006742468B2

(12) United States Patent
Mele

(10) Patent No.: US 6,742,468 B2
(45) Date of Patent: Jun. 1, 2004

(54) AQUATIC PLATFORMS

(75) Inventor: Peter Mele, P.O. Box 533, Crown Point, NY (US) 12928

(73) Assignee: Peter Mele, Crown Pt., NY (US)

( * ) Notice: Subject to any disclaimer, the term of this patent is extended or adjusted under 35 U.S.C. 154(b) by 0 days.

(21) Appl. No.: 10/236,752

(22) Filed: Sep. 5, 2002

(65) Prior Publication Data

US 2004/0045491 A1 Mar. 11, 2004

(51) Int. Cl.[7] ..... B63B 35/73
(52) U.S. Cl. ..... 114/264; 472/128
(58) Field of Search ..... 114/264; 405/3; 472/128, 129

(56) References Cited

U.S. PATENT DOCUMENTS 4,773,346 A * 9/1988 Blanding et al. ..... 114/45
5,299,588 A * 4/1994 MacLeod ..... 135/16

* cited by examiner

*Primary Examiner*—Sherman Basinger
(74) *Attorney, Agent, or Firm*—George Kersey

(57) ABSTRACT

Aquatic apparatus formed by a support with a fixed tube positioned thereon and having an open end; a movable tube encircles the fixed tube is sealed thereto, and has a pivoted end cap beyond the position of the seal and at least one vent below the position of the seal; the end cap is controlled and pressurized fluid is applied to the fixed tube.

20 Claims, 7 Drawing Sheets

AQUATIC PLATFORMS

BACKGROUND OF THE INVENTION

This invention relates to fluid controlled aquatic platforms and, more particularly, to fluid controlled platforms that can be used for general recreation.

Conventional dive platforms generally are fixed structures that have fixed locations in relation to the bodies of water where they are used.

Accordingly, it is an object of the invention to provide greater flexibility for platforms that are used for aquatic recreation, such as diving and jumping.

Another object of the invention is to make use of fluidic induced movements in conjunction with aquatic or dive platforms.

A further object of the invention is to provide aquatic platforms that give enhanced recreational effects.

SUMMARY OF THE INVENTION

In accomplishing the foregoing and related objects, the invention provides aquatic apparatus in which a fixed tube or cylinder, with an open end, is positioned on a support in the form of a base frame that may connect to a poolside or ladder. A movable tube or cylinder having a pivoted end cap encircles the fixed tube or cylinder and is sealed to it. At least one vent is located in the movable tube or cylinder below the position of the seal to the fixed tube or cylinder. Provision is made for controlling the end cap, illustratively by an aquatic or dive platform, and pressurized fluid is applied to the fixed tube.

In accordance with one aspect of the invention, the float support is formed by a plurality of at least three pontoons connected to the fixed tube. Adjoining ones of the pontoons can be connected by legs, and a platform is pivotally connected to the moveable tube.

In accordance with another aspect of the invention, the platform controls the end cap of the movable tube, for example, by at least one cable, rod, or the like, that extends from the platform to the end cap; whereby the downward pivoting of the platform can produce closure by the action of the end cap on the movable tube.

When pressurized fluid is applied to the fixed tube, for example, through a hose, and the platform is free to move, the pressurized fluid forces the end cap to an open position and the fluid exits from the aquatic structure in the form of a spray. When pressure is applied to the platform, for example, by having a person stand on it, the end cap is moved downwardly to a closed position and pressurized fluid (between the top of the fixed tube and the moveable tube) causes the movable tube to rise, simultaneously elevating the platform on which a person, such as a swimmer, is standing. When the swimmer dives from the elevated platform, the system returns to its prior condition with the end cap open and fluid exiting in the form of a spray.

In accordance with a further aspect of the invention, the seal between the fixed and movable tubes is provided by a grommet that surrounds a cylindrical ring at an intermediate or top end location on the fixed tube. The grommet engages the inner wall of the movable tube. A keyway and key can be provided between the fixed and movable tubes to stabilize the movement of the movable tube relative to the fixed tube.

In a method of the invention for using aquatic apparatus, the steps include (a) applying fluid pressure to a fixed tube connected to a float support and surrounded by a movable tube with a seal therebetween; (b) allowing the fluid applied to the fixed tube to exit at the ends of both the fixed and movable tubes; and (c) capping the exit end of the movable tube so that the applied fluid causes the movable tube to rise in relation to the fixed tube.

The method further includes the step of pivotally connecting a platform to a moveable tube and linking the platform with the capping member of the movable tube by at least one cable, whereby downward pivoting of the platform caps the movable tube and causes it to rise in relation to said fixed tube.

The method can also include the step of providing fluid exhaust holes in the movable tube below the location of the seal between the fixed and movable tubes in order to control the extent to which the movable tube can rise in relation to the fixed tube when the movable tube is capped.

In a method of the invention for manufacturing aquatic apparatus, the steps include (a) fabricating a float support; (b) attaching a hollow outlet tube to the float support; (c) surrounding the hollow outlet tube by a movable tube having an openable end cap, and (d) providing a seal between the hollow outlet tube and the surrounding movable tube. The openable end cap can be pivotable, slidable or otherwise openable. A platform can be connected to the moveable tube for controlling the end cap.

DESCRIPTION OF THE DRAWINGS

Other aspects of the invention will become apparent after considering several illustrative embodiments, taken in conjunction with the drawings in which.

DETAILED DESCRIPTION

Figure 1:
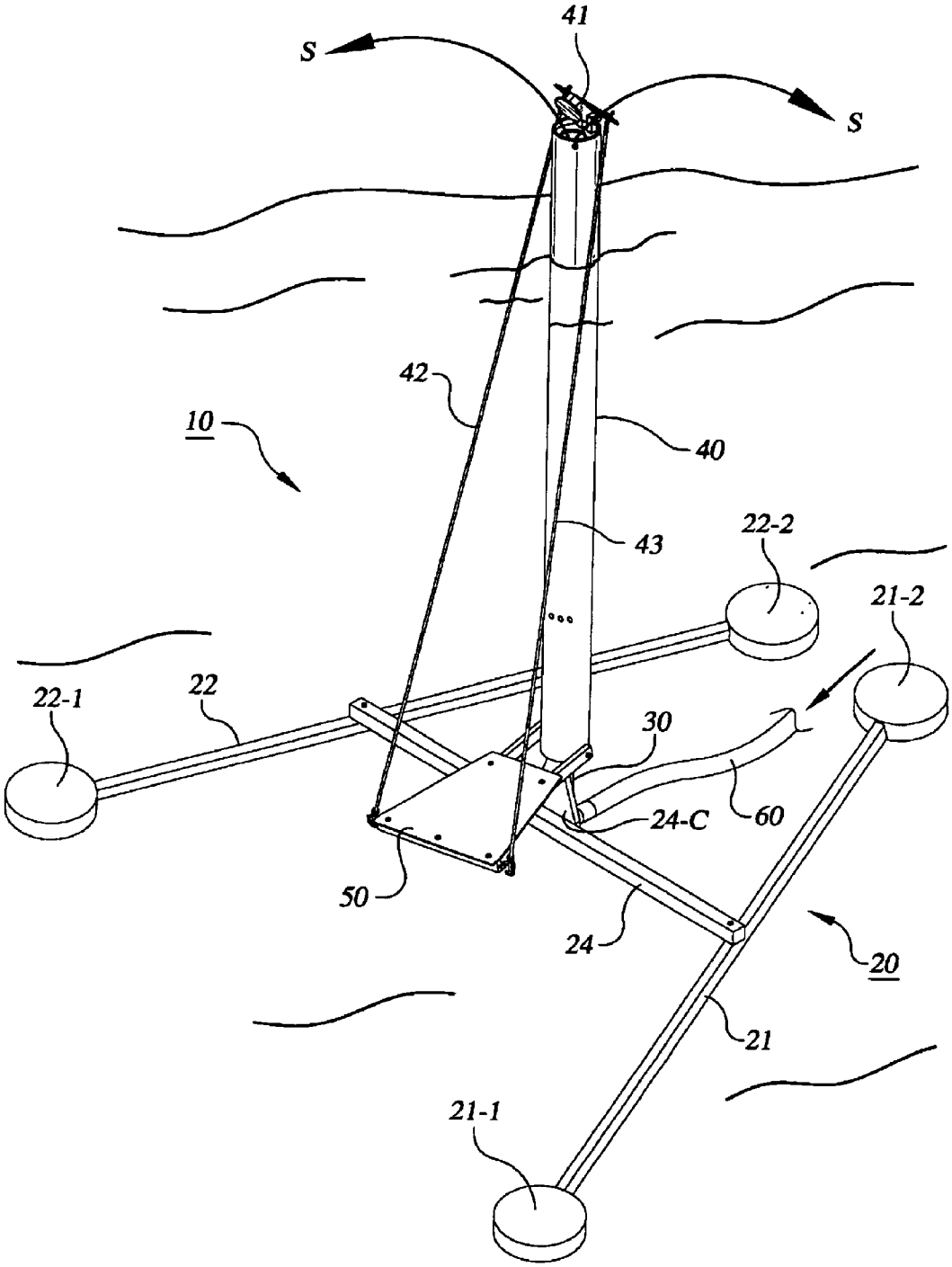
FIG. 1 is a perspective view of an aquatic device in accordance with the invention with an unoccupied diving platform.

With reference to the drawings, the aquatic structure 10 of the invention is formed by a support 20 connected to a fixed tube 30 and surrounded by a movable outer tube 40 that has a closeable end cap 41. Control cables 42 and 43 extend from the pivoted end cap 41 to a diving platform 50, and a source of fluid pressure, such as supplied by a hose 60, is connected to the fixed inner tube 30. The diving platform 50 of FIG. 1 is pivoted, but it could also flex or slide.

Figure 2:
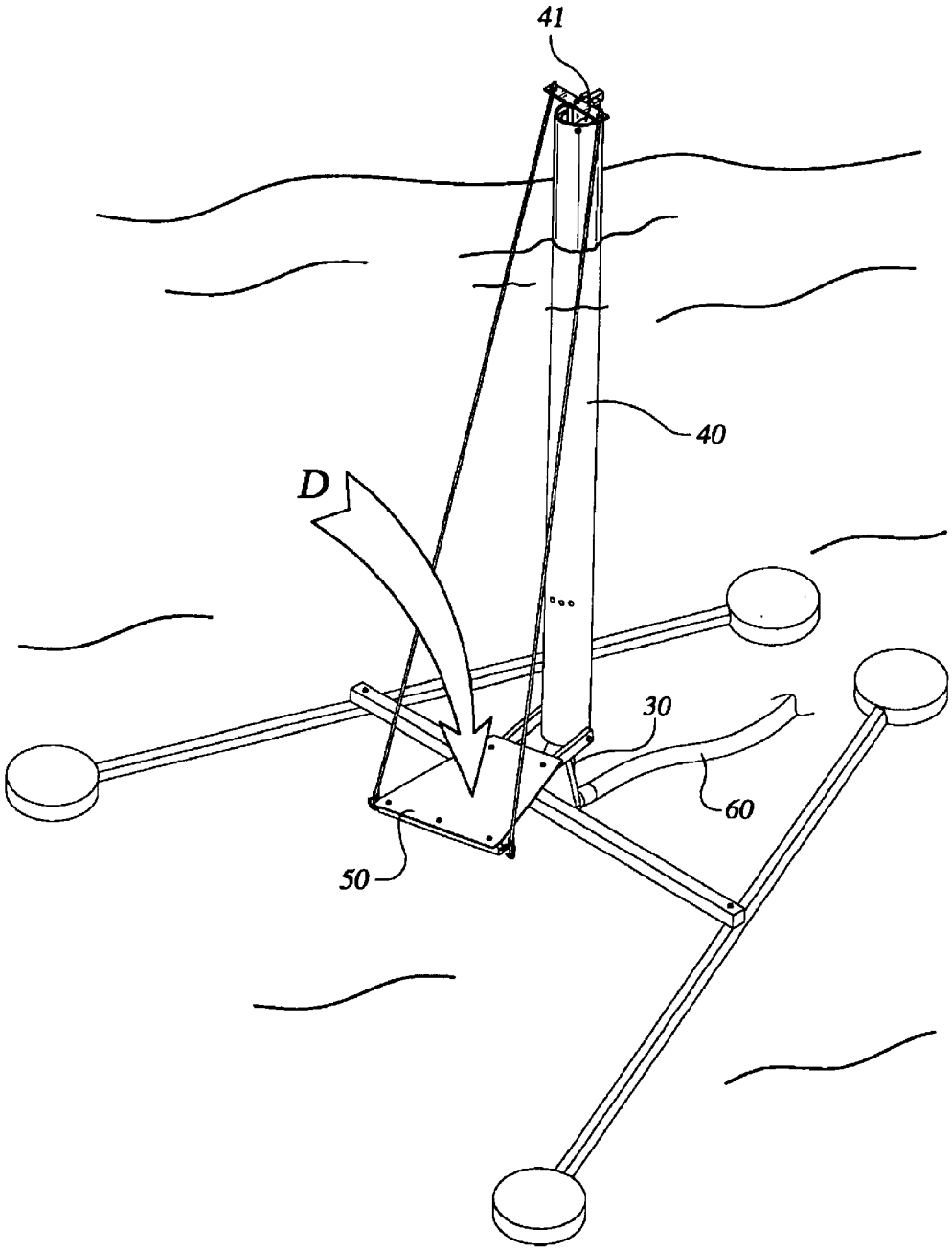
FIG. 2 is a view showing the result of having the diving platform of FIG. 1 occupied.

As indicated in FIG. 1, when the diving platform 50 is unoccupied, fluid under pressure applied by the hose 60 rises in the inner tube 30 and forces open the pivoted end cap 41. The result is that there is an outward spray, indicated by the arrow S, of fluid from above the end cap 41. When the platform 50 is occupied, as represented in FIG. 2 by the downward pressure arrow D, the pivoted end cap is moved to its closed position. Fluid in the inner tube 30 then applies pressure to the outer tube 40, causing it to rise. This elevates the platform 50 until the elevation of the outer tube 40 allows fluid escape through vent holes in the outer tube.

In FIG. 1 the support 20 is formed by four float pontoons. When the support 20 is to be attached to a structure associated with a pool, suction cups may be used and in other circumstances, rubber legs can be used. The pontoons 21-1 and 21-2 are joined by a side connector 21, and the float pontoons 22-1 and 22-2 are joined by a side connector 22. The connectors 21 and 22 are joined in turn by a cross-connector 24 which is used to fix the location of the inner tube 30 at the center position 24-C.

Figure 3A:
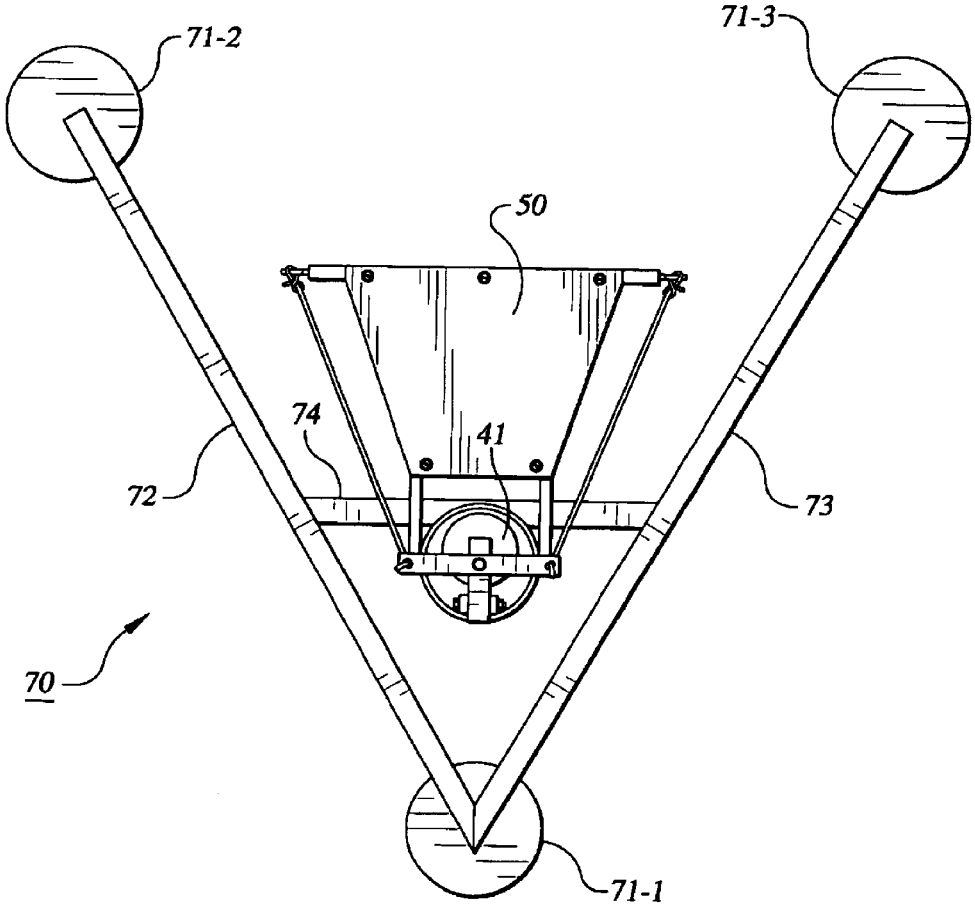
FIG. 3A is a plan view of an illustrative base frame float support for the aquatic diving platform of the invention.

In an alternative form of the support 70, shown in FIG. 3A, only three pontoons 71-1 through 71-3 are employed. Pontoons 71-1 and 71-2 are joined by a connecting leg 72, and pontoons 71-1 and 71-3 are joined by a connecting leg 73. The connectors 72 and 73 are in turn joined by a cross-connector 74 where the platform 50 is pivotally secured to the movable tube (not visible in FIG. 3A).

Figure 3B:
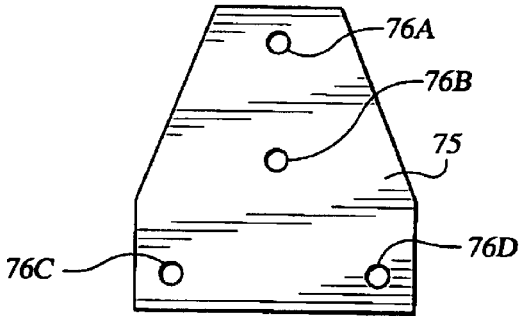
FIG. 3B is a view of a triangular plate for securing the fixed tube of the aquatic device to the float support.
Figure 4:
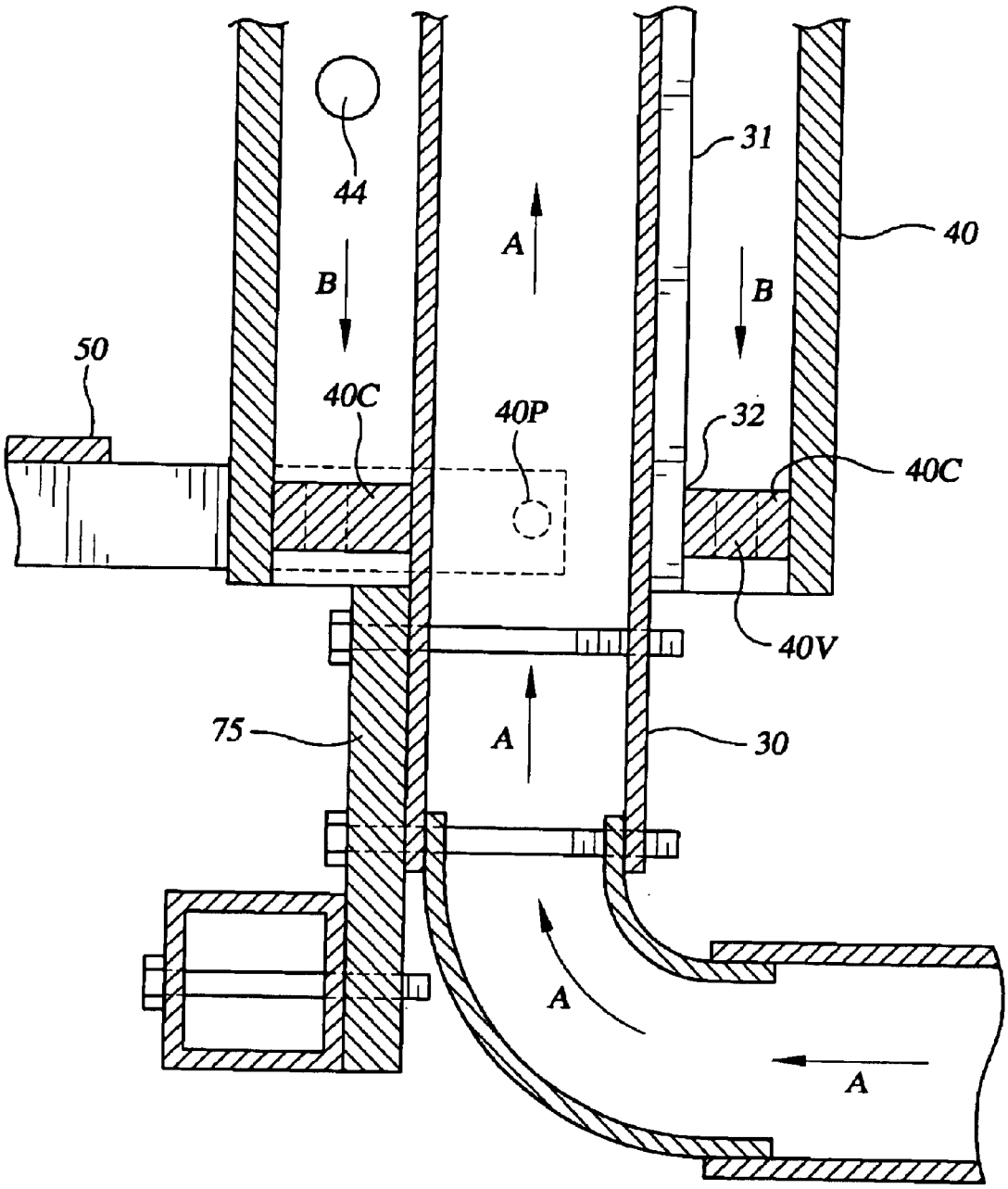
FIG. 4 is a partial sectional side view of a lower portion of the fixed tube attached to a float support and surrounded by a movable tube.

In order to secure the fixed tube 30 to the float support 70, a triangular plate 75 shown in FIG. 3B, may be employed by being secured to the cross-connector 74, as shown in FIG. 4. In a working embodiment of the invention, the triangular plate 75 was 4" in height with bolt holes 76A and 76B used to attach the plate to the inner tube 30 as shown in FIG. 4. Additional bolt holes 76C and 76D secure the plate 75 to the cross-connector 74 also, as shown in FIG. 4. The float support 70 had legs 72 and 73 that were 5' in length.

As shown in FIG. 4, the outer, movable tube or cylinder 40 has a bottom cylindrical end cap 40C and vent holes, such as the vent hole 40V in the end cap 40C. There is a pivot 40P into the end cap for the dive platform 50 and the triangular plate of FIG. 3B is bolted into the column and horizontal base frame of the float support 70. The fixed inner tube or cylinder 30 can have an elongated key 31 and a keyway 32 in the end cap 40C for stabilizing the movement of the movable tube or cylinder 40 with respect to the fixed inner tube or cylinder 30. Also shown in FIG. 4, is one of the vent holes 44 by which water is exhausted when there is an occupant on the dive platform 50 at the end of rise.

In a working embodiment of the invention, there were five water exhaust holes 44 and four vent holes 44V.

Figure 5:
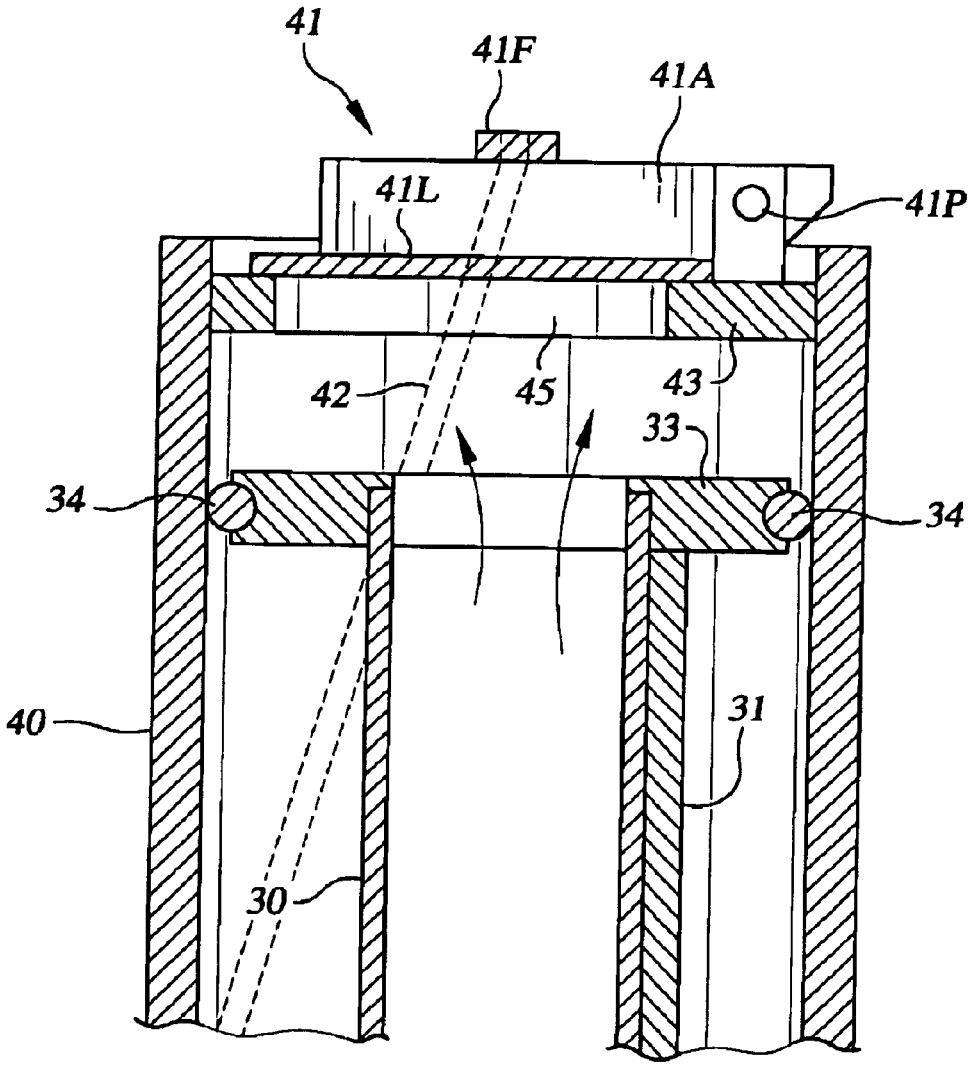
FIG. 5 is a partial sectional side view of the upper portion of the fixed and movable tubes of FIG. 4.

The upper structure showing the relationship between the fixed cylinder 30 and the movable cylinder 40 is shown in FIG. 5. The elongated key 31 on one side of the fixed column 30 extends to a ring cap 33 for the fixed column 30. A toroidal grommet, i.e., "O"-ring, 34 encircles the column cap 33 and provides a seal against the outer cylinder 40.

The upper end of the movable cylinder 40 has a cylinder cap 43 with an off-center opening 45 that is closed by a lid 41L of the pivoted end cap 41, which includes a pivot arm 41A and a lid 41L. A pivot 41P is located at the top of the outer cylinder 40. A control cable 42, for example, of rope, extends from a fitting 41F at the top of the pivot arm 41A to the dive platform 50. In a working model of the invention, the inner and outer cylinders 30 and 40 were approximately 5' in length.

Figure 6:
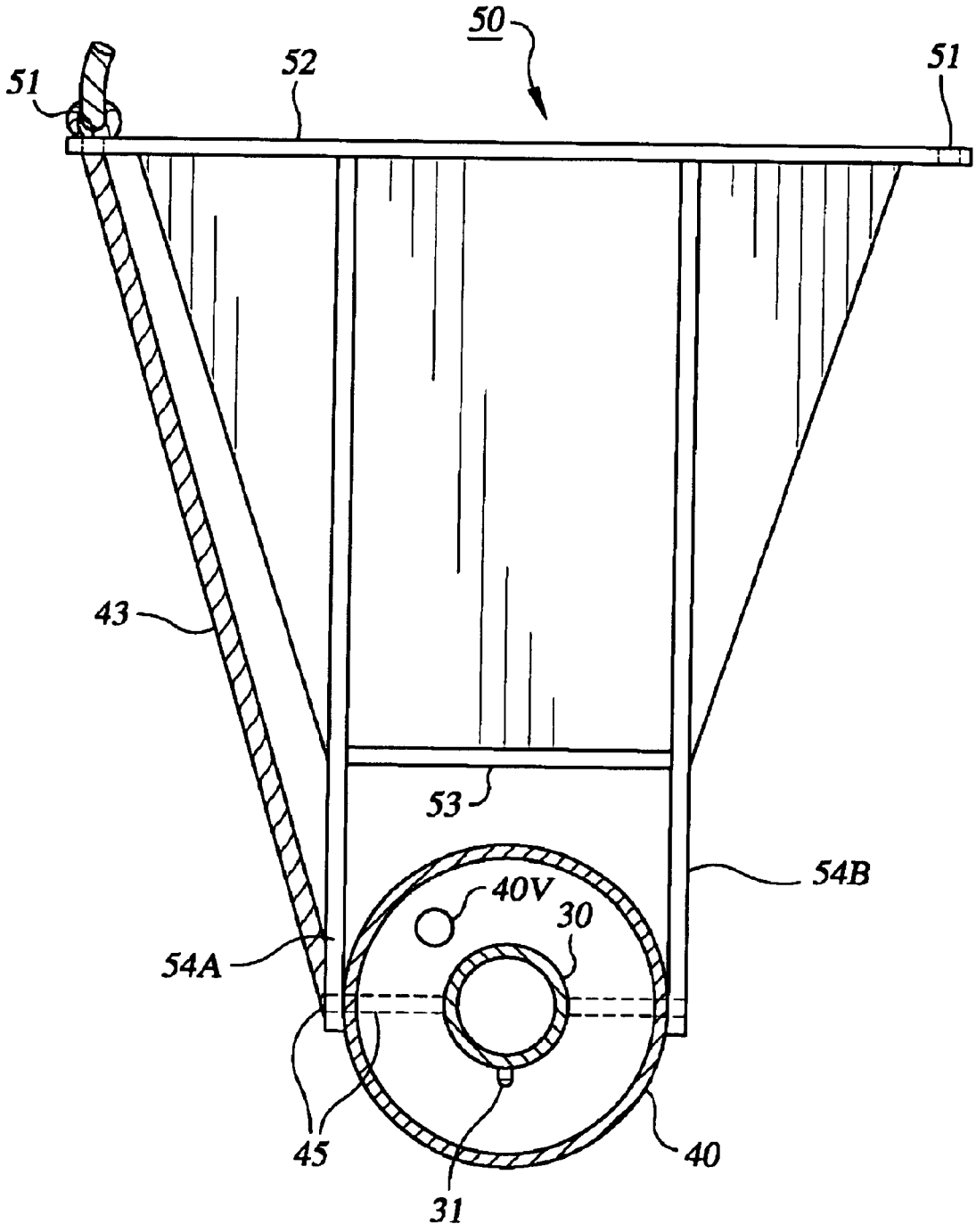
FIG. 6 is top view of the aquatic diving platform of the invention with the fixed and moveable tubes in section.

Details of the relationship between the dive platform and the cylinders 30 and 40 are shown in FIG. 6. The dive platform 50 is illustratively in the form of a trapezoid with the rope or cable 43 connected at the base of the trapezoid through a hole 51 which allows the end of the rope to be knotted against the base 52. From the opposite end 53 of the trapezoidal platform 50 extend opposed pivot arms 54A and 54B. These arms are in turn affixed to opposite ends of pivot shafts 45. Also shown in FIG. 6 is a vent hole 40V which is one of four illustrative vent holes in the base of the cylindrical end cap for the outer or movable tube or cylinder 40.

Figure 7:
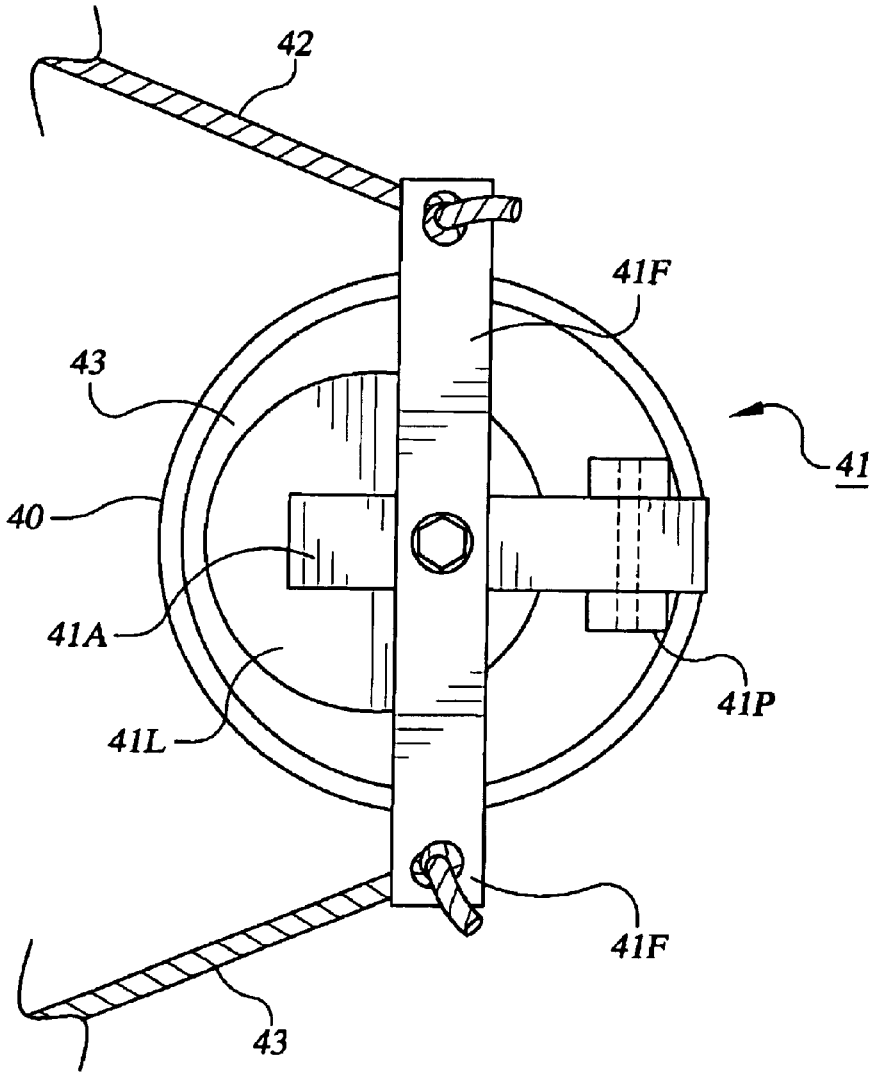
FIG. 7 is a top view of the end cap associated with the moveable tube, and associated structure.

In the top view of FIG. 7 the interrelation is shown between the fixed cylinder 30 and the movable cylinder 40.

It will be understood that the foregoing detailed description is illustrative only and that modifications and adaptations may be made without departing from the spirit and scope of the invention as defined by the appended claims.

What is claimed:

1. Aquatic apparatus comprising a float support;

a fixed tube positioned on said support and having an open end;

a movable tube encircling said fixed tube and sealed thereto;

said movable tube having a pivoted end cap beyond the position of the seal to said fixed tube and at least one vent below the position of said seal;

means for controlling said end cap; and means for applying pressurized fluid to said fixed tube.

2. Apparatus as defined in claim 1 wherein said float support comprises a plurality of pontoons connected to said fixed tube.

3. Apparatus as defined in claim 2 wherein there are at least three of said pontoons.

4. Apparatus as defined in claim 2 wherein adjoining ones of said pontoons are connected by legs.

5. Apparatus as defined in claim 1 wherein a platform is pivotally connected to said support for controlling said apparatus.

6. Apparatus as defined in claim 5 wherein said platform controls said end cap.

7. Apparatus as defined in claim 6 wherein at least one cable extends from said platform to said end cap; whereby the downward pivoting of said platform closes said fixed tube by said end cap.

8. Apparatus as defined in claim 1 wherein the means for applying pressurized fluid to said fixed tube comprises a hose.

9. Apparatus as defined in claim 1 wherein said seal is provided by a cylindrical ring at the end of said fixed tube surrounded by a grommet that engages the inner wall of said movable tube.

10. Apparatus as defined in claim 1 wherein a keyway and key are provided between said fixed and movable tubes to stabilize the movement of said movable tube relative to said fixed tube.

11. The method of using aquatic apparatus comprising the steps of:

(a) applying fluid pressure to a fixed tube connected to a float support and surrounded by a movable tube with a seal therebetween;

(b) allowing the fluid applied to said fixed tube to exit at the ends of both said fixed tube and said movable tube surrounding said fixed tube; and (c) capping the exit end of said movable tube by a capping member whereby said applied fluid causes said movable tube to rise in relation to said fixed tube;

further including the step of pivotally connecting a platform to said float support and linking said platform with said capping member of said movable tube whereby downward pivoting of said platform caps said movable tube and causes it to rise in relation to said fixed tube.

12. The method as defined in claim 11, further including the step of linking said platform to said capping member by at least one cable.

13. The method as defined in claim 11 further including the step of uncapping said exit end of said movable tube.

14. The method of using aquatic apparatus comprising the steps of:

(a) applying fluid pressure to a fixed tube connected to a float support and surrounded by a movable tube with a seal therebetween;

(b) allowing the fluid applied to said fixed tube to exit at the ends of both said fixed tube and said movable tube surrounding said fixed tube; and (c) capping the exit end of said movable tube whereby said applied fluid causes said movable tube to rise in relation to said fixed tube;

further including the step of providing fluid exhaust holes in said movable tube below the location of said seal between said fixed and movable tubes; thereby to control the extent to which said movable tube can rise in relation to said fixed tube when said movable tube is capped and fluid is applied from an aquatic source.

15. The method as defined in claim 14 further including the step of uncapping said exit end of said movable tube.

16. The method as defined in claim 14, further including the step of connecting said aquatic source to said fixed tube by a hose at a swivel joint.

17. The method of claim 14 further including the step of placing said aquatic apparatus in a body of water.

18. The method of manufacturing aquatic apparatus comprising the steps of:

(a) fabricating a float support;

(b) attaching a hollow outlet tube to said float support; and (c) surrounding said hollow outlet tube by a movable tube having an end cap; and (d) providing a seal between said hollow outlet tube and the surrounding movable tube;

wherein a platform is pivotally connected to said float support for controlling said end cap.

19. The method as defined in claim 18 wherein said platform is lined to said end cap by at least one cable.

20. The method as defined in claim 18 wherein said end cap can be closed against said moveable tube and opened with respect thereto.

* * * * *